United States Patent [19]

Deuser et al.

[11] 4,149,971

[45] Apr. 17, 1979

[54] TWO-STAGE PROCESS AND APPARATUS FOR THE SEPARATION OF TAR

[75] Inventors: Norbert Deuser, Essen; Friedrich-Paul Austermuhle, Kaarst, both of Fed. Rep. of Germany

[73] Assignee: Krupp-Koppers GmbH, Essen, Fed. Rep. of Germany

[21] Appl. No.: 797,907

[22] Filed: May 18, 1977

[30] Foreign Application Priority Data

May 29, 1976 [DE] Fed. Rep. of Germany ..... 2624246

[51] Int. Cl.[2] ..... C10J 3/68; B01D 47/06; B01D 21/26

[52] U.S. Cl. ..... 210/71; 48/206; 55/85; 208/39; 210/73 W; 210/195 S; 210/537

[58] Field of Search ..... 110/31; 366/315; 55/85, 55/89; 210/537, 83, 71, 21, 22, 73, 195 S; 208/39; 48/206

[56] References Cited

U.S. PATENT DOCUMENTS

| | | | |
|---|---|---|---|
| 2,747,680 | 5/1956 | Kilpatrick | 55/85 |
| 3,780,862 | 12/1973 | Mesing | 210/195 S X |
| 3,971,635 | 7/1976 | Matthews | 48/206 X |
| 4,031,030 | 6/1977 | Rudolph | 48/206 X |
| 4,036,606 | 7/1977 | Zimmermann et al. | 55/85 X |

*Primary Examiner*—Frank A. Spear, Jr.
*Attorney, Agent, or Firm*—R. Lawrence Sahr

[57] ABSTRACT

A two-stage process for the separation of tar, from the condensates which result from the cooling of coke oven or generator gas, is disclosed along with the apparatus for carrying out the process. The condensates are first separated in a preliminary stage into a water phase, a tar phase and a thick tar phase. The tar phase is then further dehydrated in a pressure separator.

7 Claims, 1 Drawing Figure

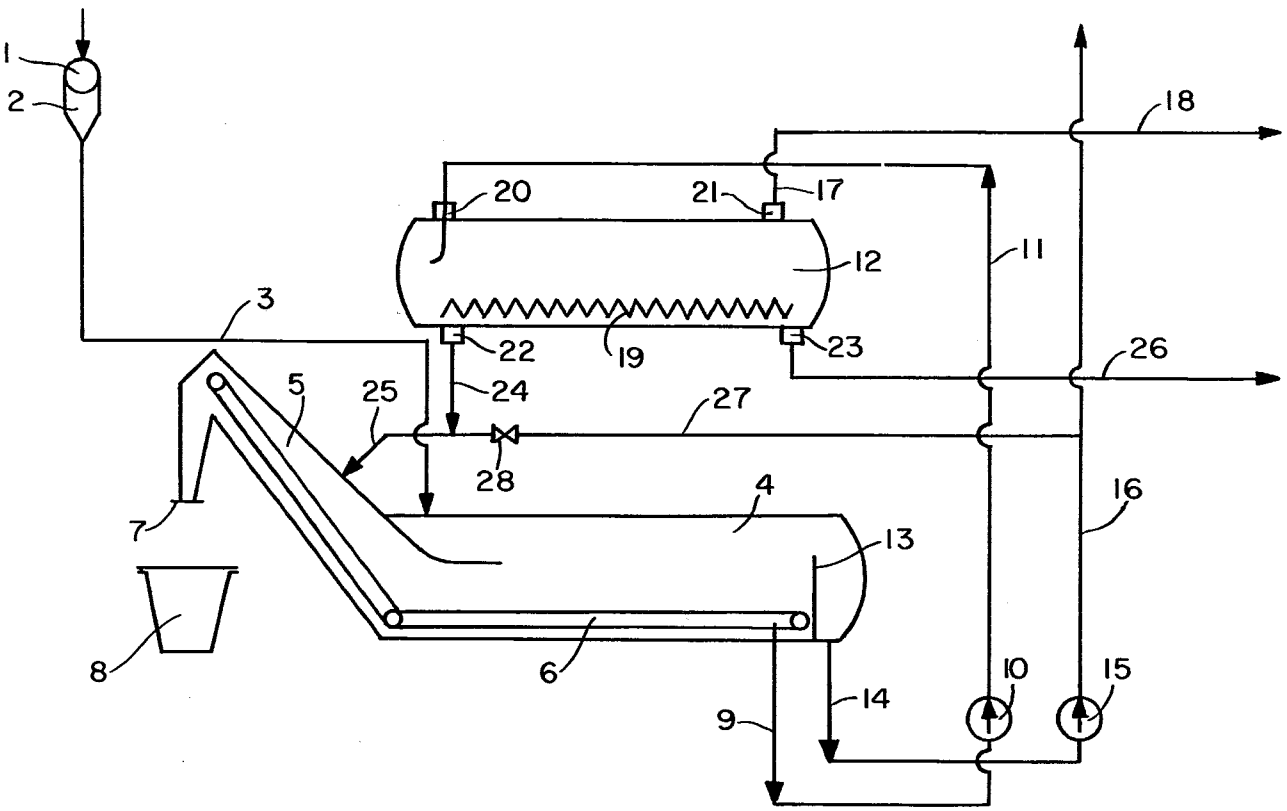
1
2
3
4
5
6
7
8
9
10
11
12
13
14
15
16
17
18
19
20
21
22
23
24
25
26
27
28

TWO-STAGE PROCESS AND APPARATUS FOR THE SEPARATION OF TAR

BACKGROUND OF THE INVENTION

1. Field of the Invention

This invention relates generally to the treatment of coke oven or generator gases which result from the distillation of coal. Specifically, this invention relates to the separation of coal tars from coal coking gases.

2. Description of the Prior Art

Two-step separation of tar is known, in principle, in the art as described in *Ullmanns Encyclopedia of Industrial Chemistry (Ullmanns Encyclopädie der Technishen Chemie),* Vol. 10, pp. 291–292, FIG. 2 (1958). During the performance of the process therein described, wherein gas suction developed from the coke operation is applied to the condensates, a fraction of the thick tar phase is separated from the tar phase, in a pressure separator, in addition to water. The thick tar phase, which is quite viscous and slurry-like, contains a significant amount of solids, especially coal and carbon dust. This fraction of the thick tar phase, mixed with the normal tar phase, is then conveyed into a tar tank where most of the solids contained therein settle out. Because of this settling, the tar tank must be cleaned at relatively short intervals of time. The cleaning is done manually, a process which is highly distasteful to those who must perform it.

To overcome the problem of frequent manual cleaning of the tar tank, an attempted improvement has been made. A colloid mill has been tried between the pressure separator and the tar tank. The colloid mill reduces the size of the solids in the thick tar phase resulting in less frequent cleanings of the tar tank. However, the solids which do not settle out are carried from the tar tank to a tar distillation unit. These solids produce contamination of the distillate and increase the frequency of required cleaning of the tar distillation unit.

There is a need for improving the above described two-step method of tar separation such that the tar which is separated in the pressure separator will not include solids, thus eliminating the need for frequent cleaning of the tar tank or the need for a colloid mill and its attendant problems of contamination of the tar distillation unit.

SUMMARY OF THE INVENTION

The present invention provides a two-stage process for the separation of tar from the condensates of gases resulting from the distillation of coal. Apparatus by which the two-stage process can be carried out is also disclosed as part of the present invention. The condensates of the gases are pumped into a preliminary separation vessel where they separate into three layers, the first or uppermost layer being water, the second or middle layer being coal tar, and the third or bottom layer being thick, heavy tar which includes solids of coal and coke. This third or bottom layer is conveyed into a heavy tar container by mechanical means. The coal tar is then pumped into a pressurized separator tank where further heavy tar settles out to the bottom where it is subsequently conveyed to the heavy tar container. The water that has separated out as the first or uppermost layer in the preliminary separator tank is pumped out of the system. However, a portion of that water may be reintroduced back into the system as a carrier means to suspend the heavy tar, which has been removed from the pressurized separator tank, to allow that heavy tar to be pumped into the heavy tar container.

Some residual water may be present and separate out of the coal tar introduced into the pressurized separator tank. Again, this water separates as the uppermost layer and is subsequently removed from the system. This water may also be reintroduced into the system as a carrier for the heavy tar leaving the pressurized separation tank.

The pressurized separation tank requires a minimum pressure of 1.5 atmospheres absolute and a minimum temperature of 60°C. The coal tar in the pressurized separation tank separates out as the second or middle layer. After the heavy tar bottom layer is removed, the coal tar layer, which has now become the bottom layer, is removed for further distillation.

Accordingly, one of the principal features of the present invention is to provide a process by which substantially all of the heavy tar can be separated from the coal tar before distillation.

Another feature of this invention is to provide apparatus for carrying out the process which eliminates the need for frequent cleaning of either the preliminary separation vessel or the pressurized separation tank.

These and other features of this invention will be more completely disclosed and described in the following specification, the accompanying drawing, and the appended claims.

DESCRIPTION OF THE PREFERRED EMBODIMENT

Referring to the drawing, the crude coke oven gas coming from the reservoir of the coke oven battery (not shown) flows through the crude gas line 1, through which it is piped to the successive treatment stages. The tar-containing condensates, which separate out upon cooling of the crude coke oven gas, are withdrawn from the crude gas line 1 via the inlet opening 2 and the pipeline 3, and are conveyed for preliminary separation into the preliminary separation vessel 4, which is often designated as the "rinse water container" in coke furnace technology. Here the separation of the tar-containing condensate separates into the three phases of water, tar, and thick tar. This takes place at normal pressure. For the performance of the process it is preferred that the vessel 4 has the shape shown in the drawing and has the upwardly pointing member 5 located at one end. The three phases, water, tar, and thick tar, separate out, one on top of the other, in the vessel 4. The thick tar collects on the bottom of the vessel 4 and is collected by the scraper chain conveyor 6 located just above the bottom of the vessel 4. The thick tar phase is transported by this conveyor 6 to the tip of the member 5. From here the thick tar drops through the outlet opening 7, located beneath it, into the container 8, which is provided for collecting the thick tar. A tar phase separates out above the thick tar phase as a second layer. This tar phase is withdrawn from the vessel 4 by way of vessel tar pipeline 9, and is conveyed by tar pump 10 into tar pipeline 11 and a pressure separator 12. The entryway to the vessel tar pipeline 9 is so arranged that it is above the level of the thick tar phase within the vessel 4. Since the conveyor 6 operates to remove the thick tar phase from the vessel 4, the uppermost level that the thick tar phase reaches will be about equal to the top of the conveyor 6. The water collecting above the tar phase in the vessel 4, as the uppermost level, flows over a weir 13, located within the vessel 4, and can be withdrawn through the vessel water pipeline 14. The water pump 15 can convey this water back through the reservoir pipeline 16 into the reservoir of the coke oven battery.

In the pressure separator 12, the tar is introduced through the separator inlet 20. The pressure separator 12 is preferably of an internal pressure ranging between 1.5 and 2.5 atmospheres absolute and an internal temperature ranging between 60°C. and 100°C. to promote further phase separation.

The water separating out under these conditions is withdrawn from the pressure separator 12 through the separator outlet 21 and passes into a separator water pipeline 17. From there it can be removed from the system by other recovery pipelines 18. At the same time, additional thick tar separates out from the coal tar in the pressure separator 12, collecting on the bottom of the pressure separator 12. This thick tar is collected by a screw conveyor 19 located just above the bottom of, and within, the pressure separator 12, and it is conveyed continuously to an aperture 22, through which it emerges. From there the thick tar passes through a thick tar pipeline 24 and a return pipeline 25 to the vessel 4, in which it is reintroduced into the vessel 4 in the vicinity of the outlet opening 7. Since practically no flow prevails, at this point in the vessel 4, the thick tar which is reintroduced has sufficient time to settle out. It is then removed, together with the thick tar from the bottom of the vessel 4, by the scraper chain conveyor 6 and collected in container 8, from which it can be further processed. In the meantime the cleaned and dewatered coal tar is removed from the pressure separator 12 through an exit 23. This coal tar passes over the exit pipeline 26 to tar storage tanks (not shown) or to subsequent coal tar distillation system (not shown).

From pipeline reservoir 16, recirculation pipeline 27 branches off, through which water can flow to the thick tar pipeline 24 or the return pipeline 25 upon opening of a valve 28. As was stated above, this water serves as a conveying medium for the thick tar coming from the pressure separator 12. The thick tar is simultaneously diluted and rinsed into the vessel 4. This process is particularly indicated when the pressure separator 12 is not located above the vessel 4, so that, due to the unavailability of a gravity feed, a special conveying medium is required for transport of the thick tar into the thick tar pipeline 24 or the return pipeline 25. This water piped in recirculation has proven to be the most inexpensive medium for conveying the thick tar.

Upon testing the process and apparatus of the present invention, it was found that the tar storage tanks needed to be cleaned only after about two years had elapsed, while when the process of the invention was not employed, cleaning was necessary at time intervals of four to six months. Further, no significant contamination of the coal tar distillation system was noted over the course of the tests.

According to the provisions of the patent statutes, the principle and sequence of operation of the process, the preferred construction of the apparatus for carrying out the process, and the mode of operation of the process utilizing the apparatus have been explained, illustrated and described in what is considered to represent its best embodiment. However, it is to be understood that, within the scope of the appended claims, the invention may be practised otherwise than as specifically illustrated and described.

What is claimed is:

1. A two-stage process for the separation of coal tar from the tar-containing condensates obtained from the cooling of gases, which are the result of the coking of coal, comprising:

(a) separating said condensates into an uppermost first level water phase, an intermediate second level coal tar phase, and a bottom third level thick tar phase which contains particles of coal and coke, within a vessel;

(b) removing said water phase from said vessel;

(c) mechanically conveying said thick tar phase from said vessel into a receptacle;

(d) conveying said coal tar phase to a pressurized separator;

(e) separating said coal tar phase into an uppermost first level of water, an intermediate second level of coal tar, and a bottom third level of thick tar at a minimum pressure of 1.5 atmospheres absolute and a minimum temperature of 60° C. within said pressurized separator;

(f) removing said water from said pressurized separator;

(g) mechanically conveying said thick tar from said pressurized separator;

(h) recirculating said thick tar to said vessel;

(i) mechanically conveying said thick tar from said vessel to said receptacle;

(j) removing said coal tar from said pressurized separator; and (k) conveying said coal tar to means for further refinement.

2. A two-stage process as described in claim 1 wherein:

(a) said temperature within said pressurized separator is within a range of 60°C. to 100°C.; and (b) said pressure within said pressurized separator is within a range of 1.5 to 2.5 atmospheres absolute.

3. A two-stage process as described in claim 1 wherein said recirculating of said thick tar to said vessel comprises:

(a) conducting a portion of said water phase and said water to said thick tar at the point at which said thick tar is removed from said pressurized separator;

(b) diluting said thick tar with said water phase and said water to form a slurry; and (c) conducting said slurry into said vessel.

4. Apparatus for conducting a two-stage process for the separation of coal tar from the tar-containing condensates obtained from the cooling of gases, which are the result of the coking of coal, comprising:

(a) means for separating said condensates into an uppermost first level water phase, an intermediate second level tar phase, and a bottom third level thick tar phase which contains particles of coal and coke, within a vessel;

(b) means for removing said water phase from said vessel;

(c) means for mechanically conveying said thick tar phase from said vessel into a receptacle;

(d) means for conveying said coal tar phase to (e) pressurized separator means operable to separate said coal tar phase into an uppermost first level of water, an intermediate second level of coal tar, and a bottom third level of thick tar, at a minimum pressure of 1.5 atmospheres absolute and a minimum temperature of 60° C. within said pressurized separator means;

(f) means for removing said water from said pressurized separator means;

(g) means for mechanically conveying said thick tar from said pressurized separator means;

(h) means for recirculating said thick tar to said vessel;

(i) means for mechanically conveying said thick tar from said vessel to said receptacle;

(j) means for removing said coal tar from said pressurized separator means; and (k) means for conveying said coal tar to means for further refinement.

5. Apparatus for conducting a two-stage process for the separation of coal tar from the tar-containing condensates obtained from the cooling of gases, which are the result of the coking of coal as described in claim 4 wherein said pressurized separate means is elevated above said receptacle.

6. Appartus for conducting a two-stage process for the separation of coal tar from the tar-containing condensates obtained from the cooling of gases, which are the result of the coking of coal as described in claim 4 wherein said means for recirculating said thick tar to said vessel comprises:

(a) means for conducting a portion of said water phase and said water to said thick tar at the point at which said thick tar is removed from said pressurized separator means (b) means for diluting said thick tar with said water phase and said water to form a slurry; and (c) means for conducting said slurry into said vessel.

7. Apparatus for conducting a two-stage process for the separation of coal tar from the tar-containing condensates obtained from the cooling of gases, which are the result of the coking of coal as described in claim 4, further comprising:

(a) means for maintaining said temperature within said pressurized separator means within a range 60°C. to 100°C.; and (b) means for maintaining said pressure within said pressurized separtor means within a range of 1.5 to 2.5 atmospheres absolute.

* * * * *